United States Patent [19]

Roeder

[11] Patent Number: 4,836,704

[45] Date of Patent: Jun. 6, 1989

[54] APPLICATOR DEVICE

[75] Inventor: Georg Roeder, Schwabach, Fed. Rep. of Germany

[73] Assignee: Schwan-Stabilo Schwanhaeusser GmbH & Co., Nuremberg, Fed. Rep. of Germany

[21] Appl. No.: 121,406

[22] Filed: Nov. 16, 1987

[30] Foreign Application Priority Data

Dec. 4, 1986 [DE] Fed. Rep. of Germany ..... 3641390

[51] Int. Cl.[4] ..... B43K 5/08; A46B 11/02

[52] U.S. Cl. ..... 401/146; 401/176; 401/276

[58] Field of Search ..... 401/143, 146, 149, 150, 401/176, 273, 276, 278, 279; 222/321, 378, 383

[56] References Cited

U.S. PATENT DOCUMENTS 1,392,369 10/1921 Stoewsand ..... 401/150

3,118,166 1/1964 Bell ..... 401/150

3,531,224 9/1970 Clevenger et al. ..... 222/321

4,694,976 9/1987 Schuetz ..... 222/321 X

*Primary Examiner*—Richard J. Apley

*Assistant Examiner*—Franklin L. Gubernick

*Attorney, Agent, or Firm*—Bachman & LaPointe

[57] ABSTRACT

In an applicator device for applying a material such as nail varnish, with a metering pump, provided separately from the feed duct through which the viscous material passes from the container therefor to an applicator member is a pressure compensating duct which can be communicated with a vent passage extending into the interior of the container, to compensate for variations in pressure within the container. A control valve controls both the communication of the interior of the container with the applicator member through the feed duct, and also the communication of the pressure compensating duct with the vent passage. The vent passage is adapted to be closed by a non-return valve opening towards the interior of the container.

7 Claims, 2 Drawing Sheets

APPLICATOR DEVICE

BACKGROUND OF THE INVENTION

The invention relates generally to an applicator device for applying a viscous material, such as nail varnish.

One form of applicator device for applying a viscous material such as nail varnish comprises a container for containing the viscous material to be applied, with a feed duct for feeding the viscous material from the container to an applicator member. Disposed between the outlet opening of the container and an inlet opening of the feed duct is a control valve which can be actuated in the direction of opening thereof, from the exterior of the device. The device further includes a pressure compensation opening for communicating the interior of the container with the exterior of the device, to compensate for variations in pressure within the container. An applicator device of that nature is to be found for example in British patent specification No. 531 741. In that design, pressure compensation which is required as the container is progressively emptied of its material is effected as between the interior of the container and the exterior thereof, either by way of the path along which the viscous material flows from the container to the applicator member or by way of a path which is separate therefrom. In the first-mentioned situation, the viscous material may suffer from a drying-out phenomenon in the flow passage involved, as may occur for example after the applicator device has been unused for a prolonged period of time, with the result that the passage for carrying the feed of material to the applicator member becomes clogged and the device is then useless. In the second possible design configuration with a separate path for pressure compensation purposes, it is possible for the material in the container to dry up in a relatively short period of time because in that case the vent passage is in direct fluid communication with the interior of the container at all times.

In another form of applicator device of the general kind referred to above, the device may include a metering pump with the control valve being integrated in the metering pump construction. In such metering pump arrangements, the pressure compensating opening is separate from the path through which the viscous material flows to the applicator member. Now, in any construction where the pressure compensating opening is separate from the flow path for the viscous material to be applied by way of the applicator member, there is the danger that, in the event of an increased pressure in the container, the viscous material may pass to the pressure compensating opening by flowing through various constrictions and clearances in the arrangement, and may then block the pressure compensating opening. The smaller the diameter of the pressure compensating opening, the more serious is the risk of its becoming blocked in that fashion.

Another form of applicator device is to be found in German patent specification No. 811 861. That device includes a container for the material to be applied, having an applicator member and a passage for feeding the material to be applied to the applicator member. That device further includes a vent duct and a control valve, by means of which the interior of the container can be brought into fluid communication with the exterior of the device, by way of the vent duct. The vent duct also has a receiving chamber therein, to prevent the material in the container from being discharged through the vent duct.

SUMMARY OF THE INVENTION

An object of the present invention is to provide an applicator device for applying a viscous material, wherein internal duct means therein are less likely to suffer from clogging.

Another object of the present invention is to provide an applicator device for applying a viscous material which provides for satisfactory pressure compensation between the interior of the container containing the viscous material to be applied by the device, and the exterior thereof, being capable of providing a substantially free pressure compensating communication with less risk of clogging thereof over a period of non-use of the device.

Still another object of the present invention is to provide an applicator device for applying a viscous material, having a pressure compensating passage which can be easily and reliably brought into operation when the device is put into use.

Yet a further object of the present invention is to provide an applicator device for applying a material such as nail varnish, which is of a simple construction while affording reliable and tidy application of the material to be applied thereby.

In accordance with the teachings of the present invention, these and other objects are achieved by an applicator device comprising a container which in use contains a viscous material to be applied by the device, such as nail varnish. The container includes an outlet opening for the material to issue therefrom, and applicator member for appyling the viscous material. A feed duct feeds the material from the outlet opening of the container to the applicator member. A control valve is disposed between the outlet opening of the container and the inlet opening of the feed duct, and can be actuated from the exterior of the device, in the direction of opening of the control valve. In addition, a pressure compensating duct communicates the interior of the container with the exterior thereof, separately from the path for the flow of viscous material from the container to the applicator member. Disposed adjoining the pressure compensating duct is a vent duct which extends into the interior of the container and which, at its end adjoining the pressure compensating duct, has a check or non-return valve which is adapted to open towards the interior of the container. The control valve is also disposed between the pressure compensating duct and the end of the vent duct which carries the check valve. The control valve is adapted to close the pressure compensating duct when the control valve is in a non-actuated condition, that is to say when it closes off the communication between the outlet opening of the container and the inlet opening of the feed duct, and the control valve opens the pressure compensating duct when the control valve is in an actuated condition.

If therefore, in the course of discharge of the material from the container, to be applied by the applicator member, a reduced pressure is formed in the container, then that reduced pressure is compensated by way of an inward flow of air into the container through the opened pressure compensating duct and the vent duct. As long as air flows into the container in that way, the check valve at the end of the vent duct is in an open condition. If however, for example due to a rise in temperature, an increased pressure should be generated in the interior of the container, the check valve ensures that viscous material in the container cannot pass into the vent duct and thence to the pressure compensating duct. That therefore reliably prevents the pressure compensating duct and the vent duct from becoming clogged therewith.

Further objects, features and advantages of the device in accordance with the present invention will become apparent from the following description of a preferred embodiment thereof.

DESCRIPTION OF THE PREFERRED EMBODIMENT

Figure 1:
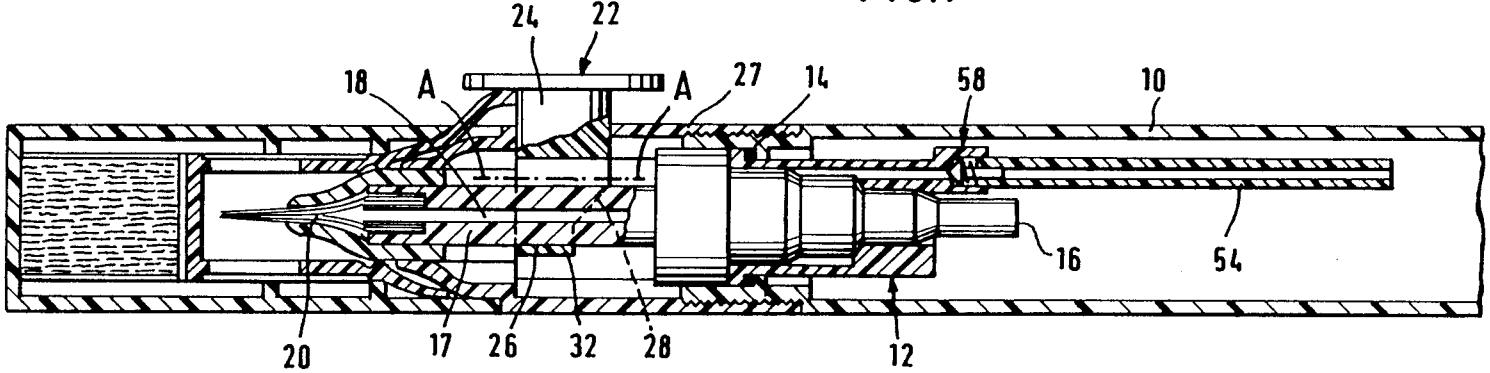
FIG. 1 is a view in longitudinal section through an embodiment of the applicator device according to the invention.

Referring now to the drawings, shown therein is an applicator device for applying a viscous material. The device may be used for any suitable material, being primarily intended in this context for the application of nail varnish.

The applicator device comprises a tubular container 10 which is open at one end, to provide an outlet opening thereof. Fitted into the outlet opening is a commercially available metering pump 12 of suitable design configuration. A metering pump as may be used in the device of this invention is described for example in German patent specification No. 1 302 372 to which reference may therefore be directed.

Figure 3:
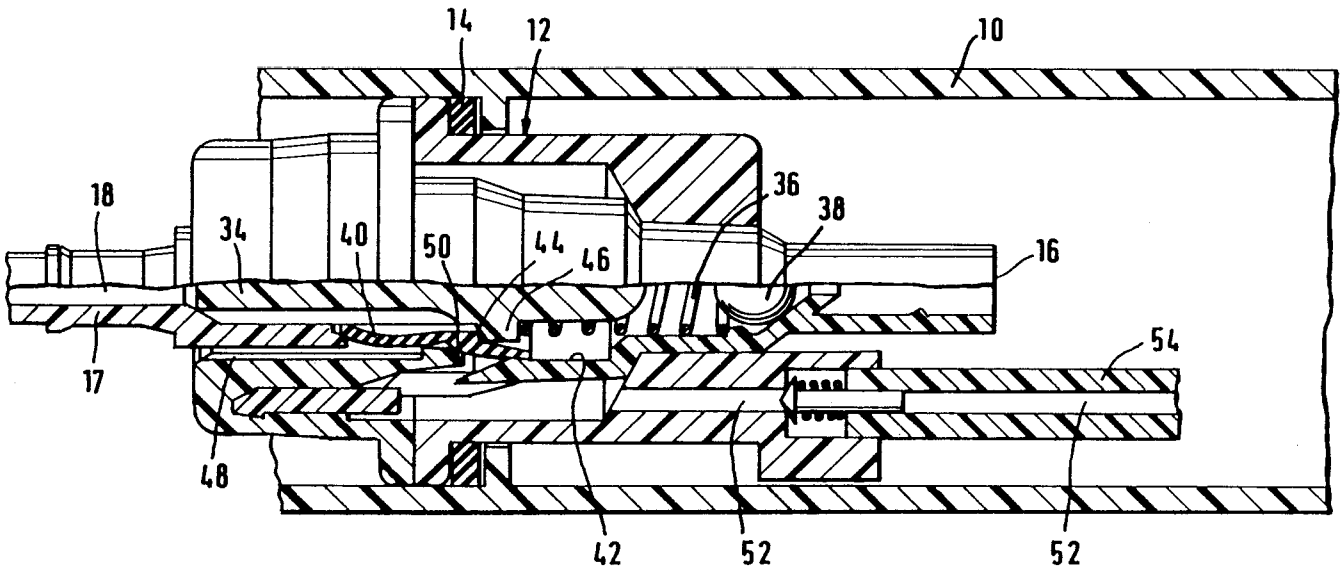
FIG. 3 is a view in longitudinal section through part of the applicator device shown in FIG. 1, illustrating details of a metering pump means thereof.

Reference numeral 14 in FIGS. 1 and 3 denotes an annular seal for providing a seal between the container 10 and the pump 12. Reference numeral 16 denotes an inlet opening of the metering pump 12.

Figure 2:
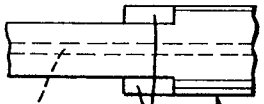
FIG. 2 is a view on to a push rod member of the applicator device, along line A—A in FIG. 1.

The pump member (not shown in detail) which is displaceable axially with respect to the applicator device is actuated by way of a push rod 17 which also provides a feed duct 18 which is in fluid communication with the outlet opening of the metering pump 12. The feed duct 18 leads therefore from the outlet opening of the container 10, through the pump 12, to the applicator member 20 which is illustrated in this embodiment in the form of a small brush. For the purposes of actuation of the pump member, the push rod 17 is displaceable axially with respect to the applicator device. It is actuated from the exterior of the device by means of a push button or knob 22 which is arranged to be actuated or depressed perpendicularly to the axis of the applicator device. The push button 22 has an actuating portion 24 comprising two limbs which embrace the push rod 17 and which, at their ends in opposite relationship to the push button 22, are connected together by means of a transverse web portion 26. The push button 22 is mounted displaceably perpendicularly to the axis of the applicator device, in a sleeve 27 which is fitted on to the container 10. As can be seen from FIG. 1, the two limbs of the actuating portion 24 are bevelled or inclined at 28, with the inclined surfaces thereof co-operating with inclined surfaces 30 as shown in FIG. 2 on the push rod 17 so that when the knob or button 22 is depressed, the push rod 17 is urged towards the right in FIG. 1. The arrangement further includes a spring 36 which is usually disposed in the metering pump 12, to urge the push rod 17 forwardly, that is to say towards the left in FIG. 1, so that the button or knob 22 is resiliently loaded towards its non-actuated or non-depressed position in FIG. 1.

Figure 1A:
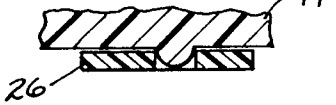
FIG. 1A shows a more detailed view of a portion of FIG. 1.

As can be clearly seen from FIG. 1A, on its web portion 26 which engages around the push rod 17 beneath same, the button or knob 22 has a retaining recess co-operating with a retaining projection on the push rod 17, thereby providing a retaining arrangement indicated at 32 in FIG. 1. The retaining arrangement 32 ensures that, in the non-actuated condition of the knob or button 22, the push rod 17 is axially locked so that the pump 12 cannot be inadvertently actuated by virtue of the applicator member 20 being pushed axially towards the right in FIG. 1, by mistake. That arresting or retaining action for holding the push rod 17 in a locked condition is automatically released when the button or knob 22 is depressed so that the metering pump 12 can then be actuated.

Referring now also to FIG. 3, the metering pump 12 illustrated therein comprises a piston or plunger 34 which is actuated by the push rod 17 and which, at the end thereof remote from the push rod 17, is supported by way of a compression coil spring 36 which is thus operable to urge the piston 34 towards and into contact with the push rod 17. At the end of the metering pump 12 which is towards the inlet opening 16 thereof, there is a check valve 38 which is in the form of a ball member co-operating with a corresponding inclined valve seat (shown but not referenced in FIG. 3). The piston 34, as shown in FIG. 3, is surrounded by a resilient annular sleeve member 40 which is also supported on the push rod 17, at the end or edge of the sleeve member 40 which is towards the left in FIG. 3, while at its end remote from the push rod 17, the sleeve member 40 bears against an inside wall surface 42 of a cylinder chamber in which the piston 34 is slidable. In the rest position shown in FIG. 3, the sleeve member 40 also bears against a shoulder 46 extending around the circumference of the piston 34, between the end of the sleeve member 40 which is supported on the push rod 17 and the end of the sleeve member 40 which is in contact with the inside wall surface 42 of the cylinder chamber for the piston 34. The contact between the shoulder 46 on the piston 34 and the inside surface portion of the annular sleeve member 40 is indicated at 44 in FIG. 3. The location 44 thus forms a control valve portion for controlling the feed flow of nail varnish from the container 10 to the applicator member 20. Thus, in use of the device, the nail varnish flows by way of the inlet opening 16, passes through the check valve 38, flows between the piston 34 and the inside wall surface 42 of the cylinder chamber, flows through the location 44 when the control valve that it defines is open, when the sleeve member 40 is thus at a spacing from the shoulder 46, with the nail varnish then flowing on between the body of the piston 34 and the sleeve member 40 into the push rod 17 which embraces the end of the piston 34 with a bell-like portion, so that the nail varnish then flows into the duct 18 and therethrough to the applicator member 20 shown in FIG. 1.

When therefore the push rod 17 is urged towards the right in FIG. 3, the piston 34 is therewith also urged towards the right, together with the sleeve member 40, against the force of the spring 36, so that the fluid material which is between the check valve 38 and the shoulder 46 is compressed. When that happens, the check valve 38 automatically closes. As from a given degree of compression of the fluid material, the resilient sleeve member 40 lifts away from the shoulder 46 at the location 44, that is to say the control valve is automatically opened and the compresssed material can thus pass into the feed duct 18. In that situation, a predetermined amount of fluid material is discharged under a predetermined pressure and, after that predetermined amount has been discharged the control valve automatically closes again, since there is no longer the pressure required to hold the sleeve member 40 at a spacing from the shoulder 46, and the spring 36 will thus drive the piston 34 together with the sleeve member 40 and the push rod 17 back into the starting position when the device ceases to be in operation.

Now, the greater the amount of fluid material taken from the container 10, the greater is the drop in pressure in the container 10 so that ultimately, the outside pressure, in comparison with the inside pressure in the container 10, is so high that no further fluid material can be taken therefrom unless special steps are taken to provide a pressure compensating effect. In the present case, that is achieved by virtue of the provision of a pressure compensating opening or duct 48 which is disposed between the push rod 17 and the housing of the metering pump 12 and which is controlled by the same control valve as that described above, for controlling the feed flow of fluid material to the applicator member 20.

Referring still therefore to FIG. 3, it will be seen therefrom that, in the non-actuated or rest position, the sleeve member 40 bears not only against the shoulder 46 on the piston 34 to close off the feed of fluid material through the location 44, but, on the outward side of the sleeve member 40, it also co-operates with the wall of the housing of the metering pump 12. That means that the pressure compensating duct 48 is closed in the rest position of the arrangement, when the applicator device is not in use. When now the piston 34 is displaced towards the right in FIG. 3 in order to compress the fluid material between the check valve 38 and the shoulder 46, the control valve advantageously first opens the pressure compensating duct 48 before the sleeve member 40 is lifted away from the shoulder 46 to permit the fluid material to flow to the applicator member 20. The pressure compensating effect therefore takes place prior to the feed flow of material to the applicator member. Refence numeral 50 denotes the location at which the vent communication through the pressure compensating duct 48 is opened and closed by the co-operation of the sleeve member 40 and the surrounding portion of the wall of the housing of the pump 12.

From the location 50, the air which is now flowing into the device from the exterior through the pressure compensating duct 48 passes into a vent passage which is formed firstly by a vent duct 52 provided in the housing of the pump 12 and which is then continued in the form of a small pipe 54 which extends into the interior of the container 10, as can be seen from both FIGS. 1 and 3. Disposed at the end of the vent duct portion 54 which is towards the pressure compensating duct 48 is a check valve 58 which is adapted to open towards the interior of the container 10. Thus for example in the event of an increase in pressure in the container 10, which may occur for example due to the temperature of the device increasing by the sun shining thereon, the check valve 58 prevents viscous material such as nail varnish in the container 10 being discharged therefrom under the increased pressure and flowing to the valve location 50 or the pressure compensating duct 48 with the result that the pressure compensating duct could be clogged after that material dried therein.

It will be appreciated that the above-described construction has been set forth solely by way of example and illustration of the present invention and that various alterations and modifications may be made therein without thereby departing from the spirit and scope of the invention.

I claim:

1. An applicator device comprising a container for containing a viscous material to be applied by the device, the container including an outlet opening for the material to issue therefrom, an applicator means for applying the viscous material, feed duct means having an inlet opening for receiving the viscous material from the container and adapted to feed it to the applicator means, a pressure compensating duct means for communicating the interior of the container with the exterior thereof separately from the path for the viscous material between the container and the applicator means, a vent duct means adjoining the pressure compensating duct means and extending in the interior of the container, a check valve in said vent duct means and adapted to open towards the interior of the container, a control valve operatively disposed between said outlet opening of the container and said inlet opening of the feed duct means to control the flow of said visous material and also operatively disposed between the pressure compensating duct means and the vent duct means, the control valve being also adapted to close the pressure compensating duct means when the control valve is in a non-actuated condition and open the pressure compensating duct means when the control valve is in an actuated condition, and means for actuating the control valve in the direction of opening thereof from the exterior of the device for viscous material to pass from said container through said feed duct means to said applicator means.

2. An applicator device for applying a viscous material, comprising: a container for containing the material, the container including an outlet opening for the material to issue therefrom; an applicator member for applying the material; a feed duct means having an inlet opening for receiving said material from said container and feeding it to said applicator member; a pressure compensating duct means for compensating for a drop in pressure within said container as said material issues therefrom to go to said applicator member by way of said feed duct means, the pressure compensating duct means comprising a first duct portion having a first end communicating with the interior of the container and a second end, and a second vent duct portion having a first end communicating with the exterior of the device and a second end; a check valve means operatively associated with said first vent duct portion and adapted to open towards the interior of the container; a control valve means operatively disposed between said outlet opening of said container and said inlet opening of said feed duct means and also operatively disposed between said second ends of said first vent duct portion and said second vent duct portion, said control valve means comprising a first valve means adapted to close the communication between said outlet opening of said container and said inlet opening of said feed duct means when said control valve means is in a closed position and to open said communication when said control valve means is in an open position, said control valve also comprising a second valve means adapted to close the communication between said second ends of said first and second vent duct portions when said control valve means is in a closed condition and to open said communication when said control valve means is in an open condition; and means for actuating the control valve in the direction of opening thereof, from the exterior of the device.

3. An applicator device as set forth in claim 2 wherein said control valve means includes a flexible annular sleeve member providing inward and outward surfaces, said inward surface being adapted to co-operate with a valve seat portion in the communication between said outlet opening of said container and said inlet opening of said feed duct means, thereby providing said first valve means, and said outward surface being adapted to co-operate with a second valve seat portion in the communication between said second ends of said first and second vent duct portions, thereby providing said second valve means.

4. An applicator device as set forth in claim 3 and further including a metering pumping means therein for pumping said material from said container to said applicator means through said feed duct means, said pumping means including a piston slidable in a cylinder.

5. An applicator device as set forth in claim 4 wherein said flexible annular sleeve member is disposed around said piston and said piston provides said first valve seat portion and said cylinder provides said second valve seat portion.

6. An applicator device as set forth in claim 2 wherein said check valve is disposed at said second end of said first vent duct portion.

7. An applicator assembly for use on a container containing a material to be applied by the assembly, comprising: a main body portion adapted to be fitted to a said container and having an intake opening for receiving material therefrom; an applicator member carried on said body portion for applying the material; a feed duct means in said body portion having an inlet opening for receiving the material from the intake opening and adapted to feed it to the applicator member; a pressure compensating duct means extending through the body portion separately from the path of flow for the material through the body portion, the pressure compensating duct means comprising a first duct portion and a second duct portion which adjoins the first duct portion and which is adapted to extend into the container; a check valve in said second duct portion and adapted to open towards the interior of the container; a control valve disposed between said intake opening of the body portion and the inlet opening of the feed duct means and also disposed between the first and second duct portions of said pressure compensating duct means, the control valve being adapted to close the pressure compensating duct means when the control valve is in a non-actuated condition of closing the communication between said intake opening and said inlet opening and open the pressure compensating duct means when the control valve is in an actuated condition communicating said intake opening and said inlet opening; and means for actuating the control valve in the direction of opening thereof from the exterior of the device for material to pass from said intake opening through said feed duct means to said applicator member.

* * * * *